US005556292A

United States Patent [19]

Kato et al.

[11] Patent Number: 5,556,292

[45] Date of Patent: Sep. 17, 1996

[54] CABLE CONNECTOR

[75] Inventors: Tatsuo Kato; Katsuhiko Kishi; Takeshi Matsuda, all of Yokohama, Japan

[73] Assignee: SMK Corporation, Tokyo, Japan

[21] Appl. No.: 410,034

[22] Filed: Mar. 23, 1995

[30] Foreign Application Priority Data

Apr. 22, 1994 [JP] Japan ..... 6-107740

[51] Int. Cl.[6] ..... H01R 27/00

[52] U.S. Cl. ..... 439/218; 439/675; 439/851

[58] Field of Search ..... 439/578–585, 439/675, 322, 344, 63, 825, 851, 842, 843, 217–221

[56] References Cited

U.S. PATENT DOCUMENTS 3,246,077 4/1966 Betcher et al. ..... 439/218
3,858,156 12/1974 Zarro ..... 439/221
4,537,453 8/1985 Takeuchi ..... 439/217
5,137,469 8/1992 Carpenter ..... 439/218

*Primary Examiner*—David L. Pirlot
*Attorney, Agent, or Firm*—Thomas R. Morrison; Christopher R. Pastel

[57] ABSTRACT

A cable connector includes a plug for connecting a coaxial cable to an electronic device such as a television or video cassette recorder. The plug includes a sleeve that connects with a first grounding terminal of a receptacle. An outer diameter of the sleeve is dimensioned to provide a good unstressed interference fit with the first grounding terminal. The sleeve has slits in a portion to permit elastic deformation when connecting with a second grounding terminal having an inner diameter less than that of the first grounding terminal. These slits permit the sleeve to compress sufficiently to form an interference fit inside the second grounding terminal. When both the first grounding terminal of the receptacle and the sleeve of the plug are dimensioned for the PAL format, and the second grounding terminal is dimensioned for the SECAM format, the plug fits either grounding terminal.

10 Claims, 8 Drawing Sheets

CABLE CONNECTOR

BACKGROUND OF THE INVENTION

The present invention relates to a cable connector such as used with an RF cable for connecting a VCR (video cassette recorder) to a TV (television) receiver (e.g., a coaxial cable with connector plugs). Such a cable connector may also be used with an antenna cable for connecting an antenna to a television receiver or VCR.

A coaxial cable has a central conductor surrounded by a concentric outer conductor and separated from it by a dielectric material. The concentric outer conductor is a metallic shield generally made of braided copper or metal tape. A cable connector is attached to a coaxial cable to plug into a receptacle on a device.

Devices such as TV's and VCR's are regionally standardized. For instance, European color television broadcasts use the PAL (Phase Alternate Line) format and SECAM (Sequential Couleur a Memoire) format, unlike the United States and Japan, which use the NTSC (National TV System Committee) format. Specifically, the PAL format is used in the United Kingdom and Germany, while the SECAM format is used in France and Russia. Physical connectors used with one format are not necessarily compatible with physical connectors used with a different format.

Referring to FIG. 8, a prior art RF cable 10 with integral connectors includes coaxial cable 11 with a socket connector 12 on one end and a plug 14 on another end. Coaxial cable 11 also includes a conventional central conductor (not shown), an insulator (not shown), and a concentric outer conductor (not shown). A center pin 16 of plug 14 is electrically connected to the central conductor of coaxial cable 11. A sleeve 20 is electrically connected to the outer conductor of coaxial cable 11. Sleeve 20 is separated from center pin 16 by an insulator 18. An insulating cover 22 over sleeve 20 protects plug 14 from the environment and provides an insulated object for a user to grasp during plugging and unplugging. A portion of center pin 16 and a portion of sleeve 20 are exposed for making contact with corresponding portions of a receptacle 30.

Receptacle 30 includes a signal terminal 32 into which center pin 16 connects. Receptacle 30 also includes a grounding terminal 34 into which sleeve 20 connects. In this state, center pin 16 of plug 14 and sleeve 20 are elastically connected to signal terminal 32 and grounding terminal 34 of receptacle 30, respectively. An electrical connection between VCR 24 and TV 28 is created by socket connector 12 connecting with a receptacle 26 and plug 14 connecting with receptacle 30.

In the PAL format, an outer diameter D of sleeve 20 of plug 14 is a standard 9.525 mm, while in the SECAM format, an outer diameter D of sleeve 20 of plug 14 is a standard 9.0 mm. An inner diameter of grounding terminal 34 of receptacle 30 is also standardized to a dimension corresponding to an adequate elastic contact. Also, the depth of the exposed portions of center pin 16 and sleeve 20, and their mating parts in receptacle 30, have standardized dimensions.

Thus, when cable 10 is made for the PAL format, it can only connect a PAL format VCR 24 and a PAL format TV receiver 28. A PAL format cable cannot be used to connect SECAM format devices (VCR's and TV's) to each other nor can it be used to connect a PAL format device to a SECAM format device. Likewise, when cable 10 is made for the SECAM format, it can only connect a SECAM format VCR and a SECAM format TV. A SECAM format cable cannot be used to connect PAL format devices (VCR's and TV's) to each other nor can it be used to connect a SECAM format device to a PAL format device. Cables with connectors of the two formats are color-coded to prevent confusion caused by attempting to connect SECAM format devices using a PAL format cable and vice versa.

Referring to FIG. 9, a conversion connector 46 permits a PAL format cable to connect a PAL format VCR to a SECAM format TV. A PAL format cable 10 includes a coaxial cable 11 and a plug 14. A SECAM format TV 36 includes a receptacle 38 which is also in the SECAM format. Conversion connector 46 includes a center connection conductor 42 and a ground connection conductor 44. Outer diameter D (9.525 mm) of sleeve 20 of plug 14 is too large to fit inside an inner diameter $N_s$ of grounding terminal 40 of receptacle 38 of SECAM TV 36. Since a standard SECAM format plug has a sleeve with an outer diameter of 9.0 mm, $N_s$ is a value smaller than 9.0 mm by a prescribed amount so that an interference fit for good elastic contact can be made.

A special cable (not shown) having a SECAM plug on one end and a PAL plug on the other end can be used instead of a conversion connector 46 to connect two dissimilar devices.

Thus, when connecting devices with different formats, such as the PAL format and the SECAM format, it is necessary to have additional parts such as a conversion connector or a conversion cable. This increases the number of parts required to be manufactured and warehoused, making operations more complicated and raising costs. Furthermore, problems arise when trying to connect dissimilar devices using a SECAM format cable or a PAL format cable. The two formats are close enough that a user often believes that the cable should connect properly. The user may then try to force a fit, thereby damaging the cable or the receptacles or making a bad connection.

OBJECTS AND SUMMARY OF THE INVENTION

The object of the present invention is to overcome the drawbacks of the prior art.

Another object of the present invention is to provide a cable with connectors that connects devices having different formats without having to use separate parts such as a conversion connector or a conversion cable.

Briefly stated, a cable connector includes a plug for connecting a coaxial cable to an electronic device such as a television or video cassette recorder. The plug includes a sleeve that connects with a first grounding terminal of a receptacle. An outer diameter of the sleeve is dimensioned to provide a good unstressed interference fit with the first grounding terminal. The sleeve has slits in a portion to permit elastic deformation when connecting with a second grounding terminal having an inner diameter less than that of the first grounding terminal. These slits permit the sleeve to compress sufficiently to form an interference fit inside the second grounding terminal. When both the first grounding terminal of the receptacle and the sleeve of the plug are dimensioned for the PAL format, and the second grounding terminal is dimensioned for the SECAM format, the plug fits either grounding terminal.

According to an embodiment of the invention, a cable connector includes a plug for alternate connection to first and second receptacles, the first and second receptacles having first and second tubular grounding terminals, respectively, the first grounding terminal having a first inner diameter, the second grounding terminal having a second inner diameter, the second inner diameter being smaller than the first inner diameter, the plug having a generally tubular sleeve for fitting inside a grounding terminal, a chamfer at an end of the sleeve, a plurality of slits longitudinally disposed in the sleeve, extending through the chamfer, the sleeve having an unstressed outer diameter, the unstressed outer diameter being effective for providing an elastic interference fit in the first inner diameter, and the chamfer and the plurality of slits permitting the sleeve to compress to form an interference fit inside the second inner diameter.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
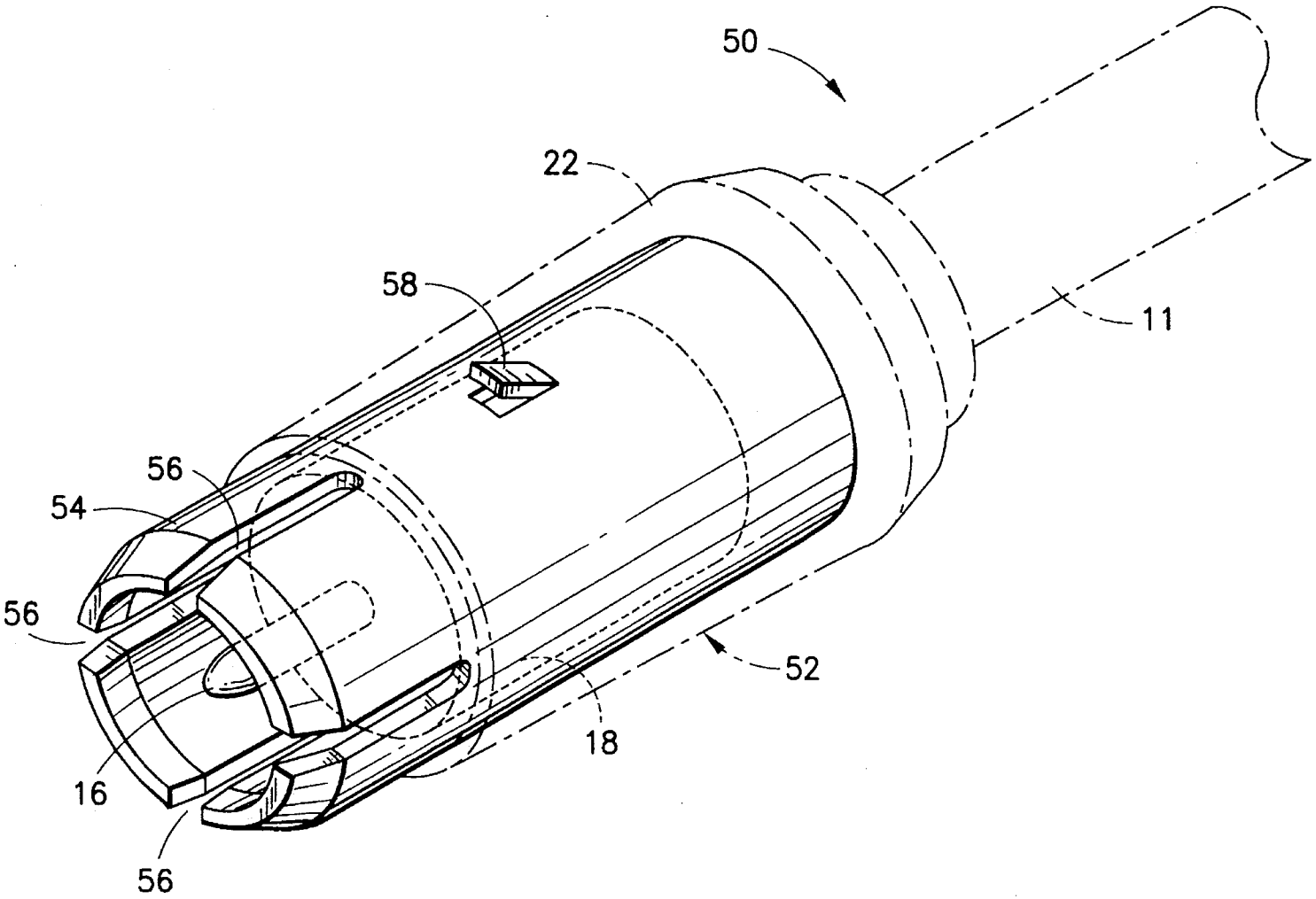
FIG. 1 shows a perspective view of an embodiment of a connector according to the present invention.
Figure 2:
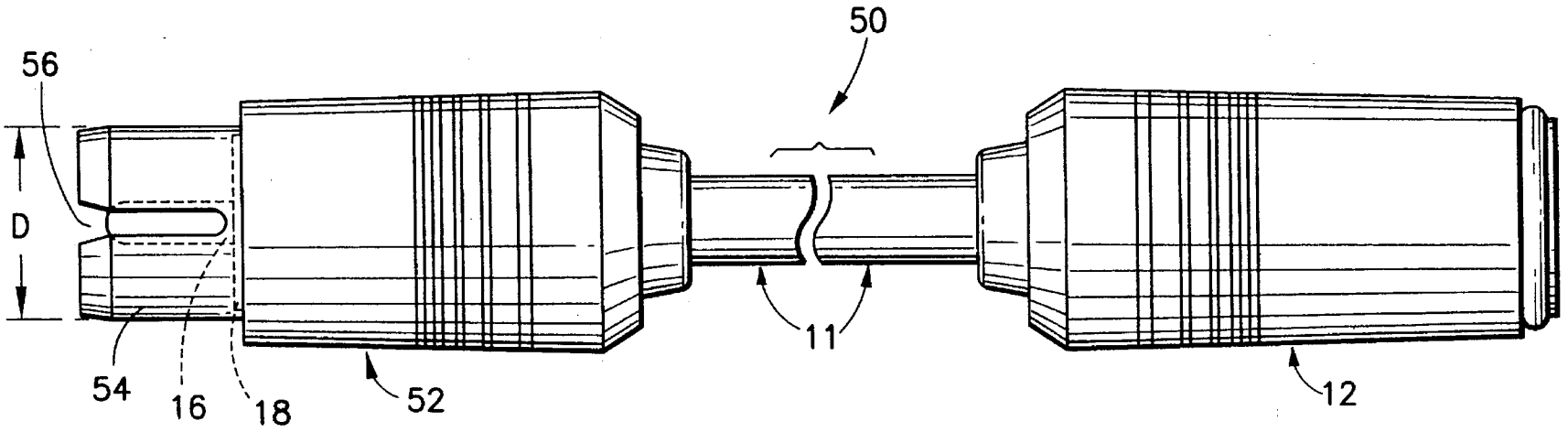
FIG. 2 shows an elevation view of an embodiment of a cable with a connector according to the present invention.

Referring to FIGS. 1 and 2, a cable 50 includes a coaxial cable 11, a socket connector 12 affixed to an end of coaxial cable 11, and a plug 52 affixed to an other end. A center pin 16 of plug 52 is electrically connected to a central conductor (not shown) of coaxial cable 11. A sleeve 54 of plug 52 is electrically connected to an outer conductor (not shown) of coaxial cable 11. Sleeve 54 has a tubular shape surrounding center pin 16 over an insulator 18. An insulating cover 22 over sleeve 54 protects plug 52 from the environment. A portion of center pin 16 and a portion of sleeve 54 are exposed for making physical and electrical contact with corresponding portions of a receptacle (not shown). Four slits 56 are in the exposed portion of sleeve 54. Each slit 56 is closed on an end toward coaxial cable 11 and open on an other end toward the receptacle. Slits 56 are relatively narrow and are elongated in the insertion direction of plug 52. Slits 56 preferably open wider toward a tip of sleeve 54. The tip of sleeve 54 is chamfered to make inserting plug 52 into the receptacle (not shown) easier. The closed end of each slit 56 is approximately at the edge of the exposed portion of sleeve 54. Very little, if any, of slits 56 overlap insulator 18. Slits 56 are substantially entirely within the exposed portion of sleeve 54. An outer diameter D of the exposed portion of sleeve 54 is substantially 9.525 mm, following the PAL format standard.

The covered portion of sleeve 54 includes at least one slip-prevention engagement piece 58 which protrudes from sleeve 54 and engages cover 22 to help prevent cover 22 from slipping off sleeve 54 during repeated use. Two slip-prevention engagement pieces 58 are preferable (only one of which is shown). More than two slip-prevention engagement pieces 58 can be used evenly spaced from each other. Each slip-prevention engagement piece 58 is formed by conventional means such as cutting and lifting.

Figure 3:
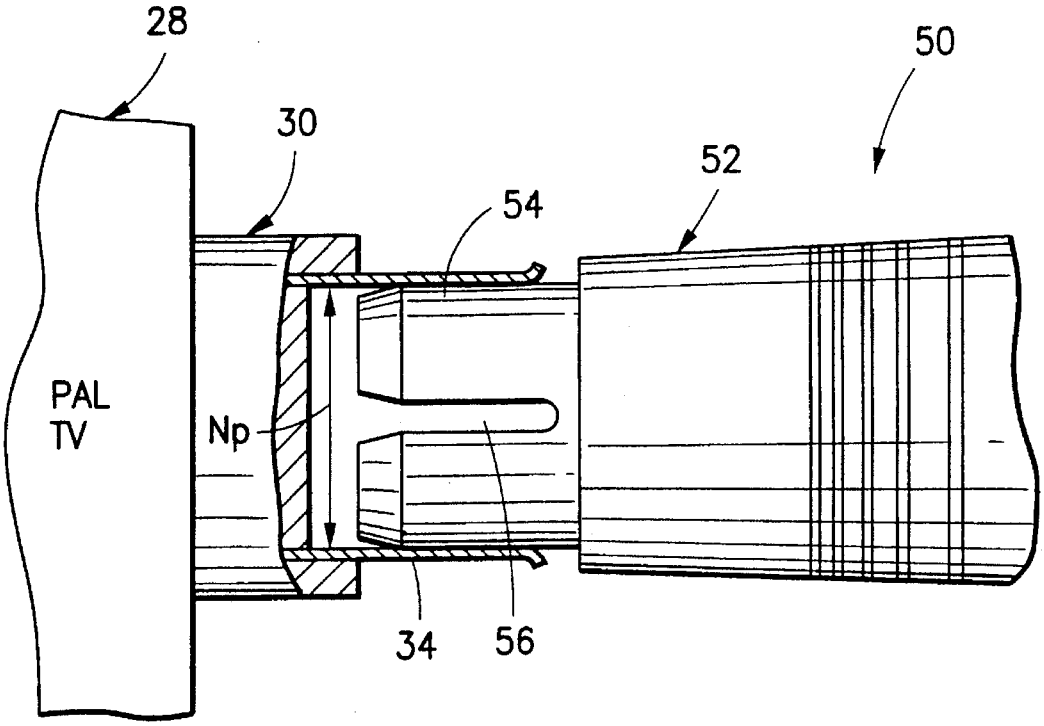
FIG. 3 shows a fragmentary view of the connector of FIGS. 1 and 2 fitted to a receptacle of a PAL format TV.

Referring to FIG. 3, an inner diameter $N_p$ of grounding terminal 34 of receptacle 30 of PAL format TV 28, in accordance with the PAL format standard, is a value smaller than 9,525 mm by a set amount in order to ensure adequate elastic contact. As stated previously, the outer diameter of the exposed portion of sleeve 54 is substantially 9,525 mm, following the PAL format standard. The outer edge of sleeve 54 thus elastically contacts the inner edge of grounding terminal 34. As with a conventional cable, cable 50 connects PAL format TV 28 to a PAL format VCR (not shown).

Figure 4:
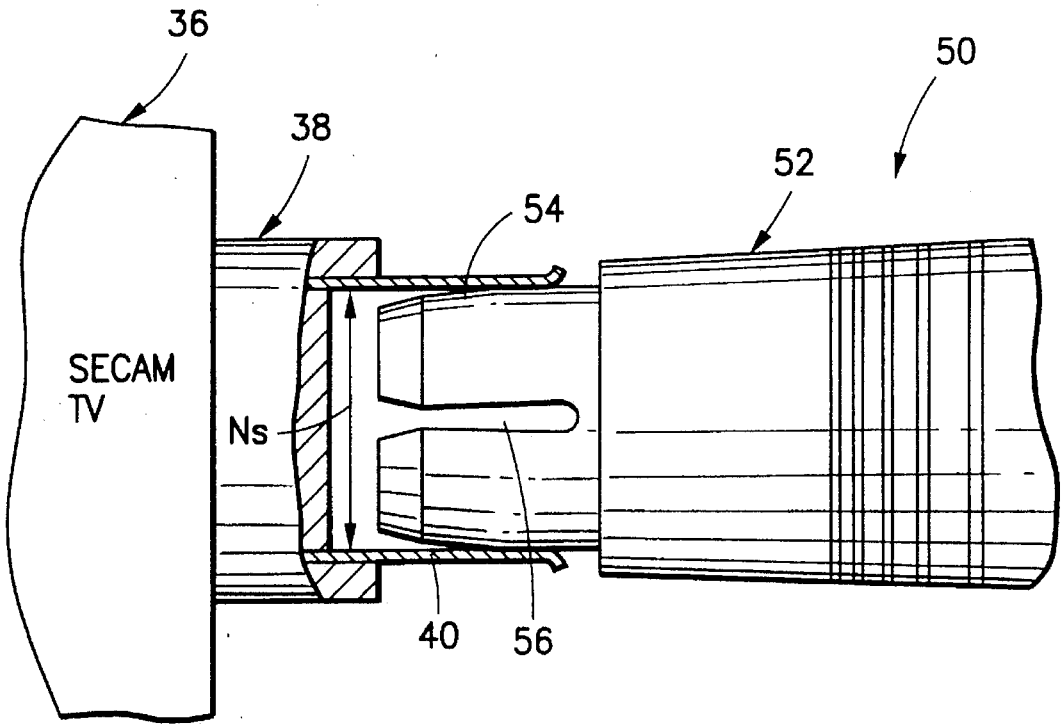
FIG. 4 shows a fragmentary view of the connector of FIGS. 1 and 2 fitted to a receptacle of a SECAM format TV.

Referring to FIG. 4, an inner diameter $N_s$ of grounding terminal 40 of receptacle 38 of SECAM format TV 36, in accordance with the SECAM format standard, is a value smaller than 9.0 mm by a set amount in order to ensure adequate elastic contact. As stated previously, the outer diameter of the exposed portion of sleeve 54 is substantially 9.525 mm, following the PAL format standard. The presence of slits 56, together with the chamfer at the end of sleeve 54, permits elastic deformation in sleeve 54 as shown. Thus, an elastic contact is formed between grounding terminal 40 of connector 38 and sleeve 54 of plug 52. Thus, a PAL format VCR (not shown) and a SECAM format TV 36 are connected to each other by a cable 50.

In this embodiment, four slits are formed at approximately equal intervals along the periphery of sleeve 54 in order to provide a roughly uniform elastic deformation of the sleeve of the plug and to provide a good elastic connection. However, the present invention is not limited to this, and can involve slits formed at irregular intervals.

In this embodiment, cable 11 includes plug 52 affixed on one end, and socket connector 12 affixed on the other. In the present invention, cable 11 includes at least one plug 52 on one end. The other end can include any other connective device or be hard wired into a device. Two plugs 52, one on each end, can also be used.

Sleeve 54 in this embodiment is tubular or cylindrical in shape, and has a circular cross section. The present invention is not limited to this, and any shape cross section can be used as long as elastic deformation of the sleeve is possible.

Figure 5:
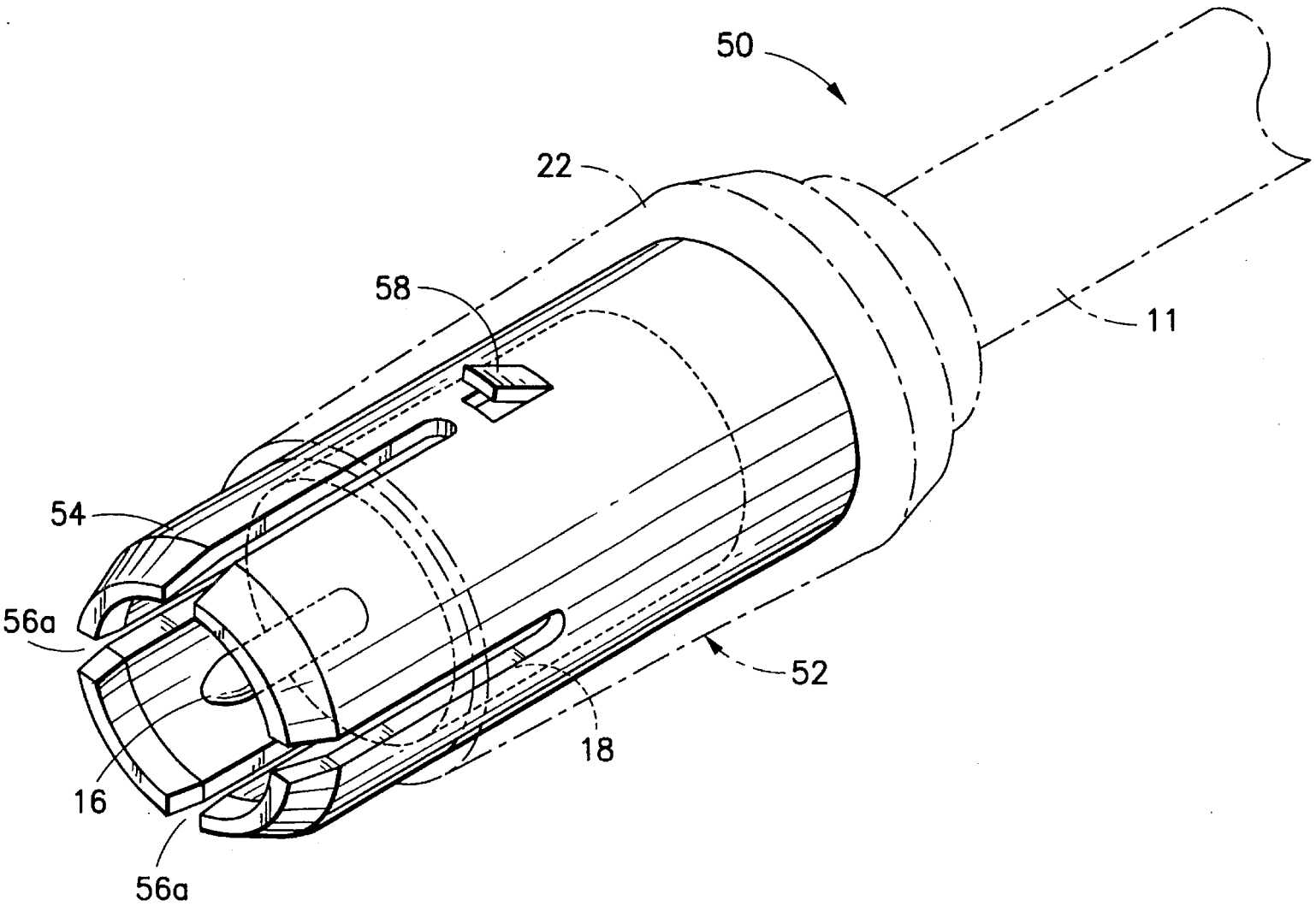
FIG. 5 shows a perspective view of a second embodiment of the present invention.

Referring to FIG. 5, an alternative embodiment includes a sleeve 54 with four slits **56*a*. Slits 56*a*, unlike slits 56 of FIG. 1, extend into the covered portion of sleeve 54 and overlap insulator 18. In the embodiment of FIG. 1, the four slits 56 are formed such that the closed end of each slit 56 is approximately at the edge of the exposed portion of sleeve 54. Slits 56 are substantially entirely within the exposed portion of sleeve 54. However, in the embodiment of FIG. 5, the dosed ends of slits 56*a*extend over insulator 18 and under cover 22. Increasing the length of each slit 56*a* increases the ability of sleeve 54 to deform elastically when plugged into a receptacle. All other components of plug 52 are the same as described above for the embodiment of FIG. 1**.

Figure 6:
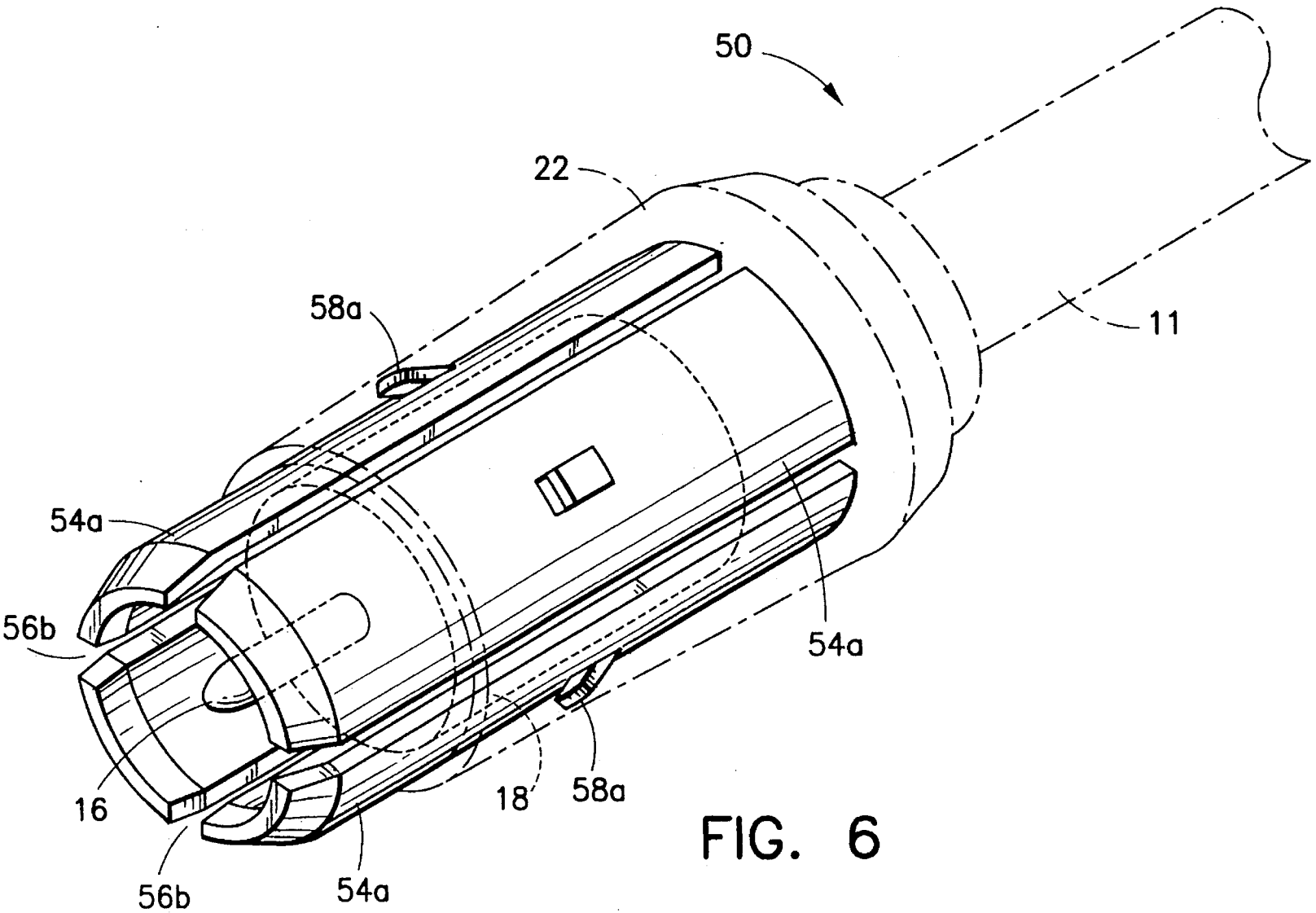
FIG. 6 shows a perspective view of a third embodiment of the present invention.

Referring to FIG. 6, a further embodiment includes a plurality of slits 56*b* that are open at both ends to separate sleeve 54 into a plurality of sleeve pieces 54*a* instead of a single sleeve 54. At least one sleeve piece 54*a*, and preferably all sleeve pieces 54*a*, is electrically connected to the outer conductor (not shown) of coaxial cable 11. Slip-prevention engagement pieces 58*a* are formed on each sleeve piece 54*a* to engage cover 22. The full length of each slit 56*b* increases the ability of sleeve pieces 54*b* to deform elastically when plugged into a receptacle. In this embodiment, four slits 56*b* are preferable. All other components of plug 52 are the same as described above for the embodiment of FIG. 1.

Figure 7:
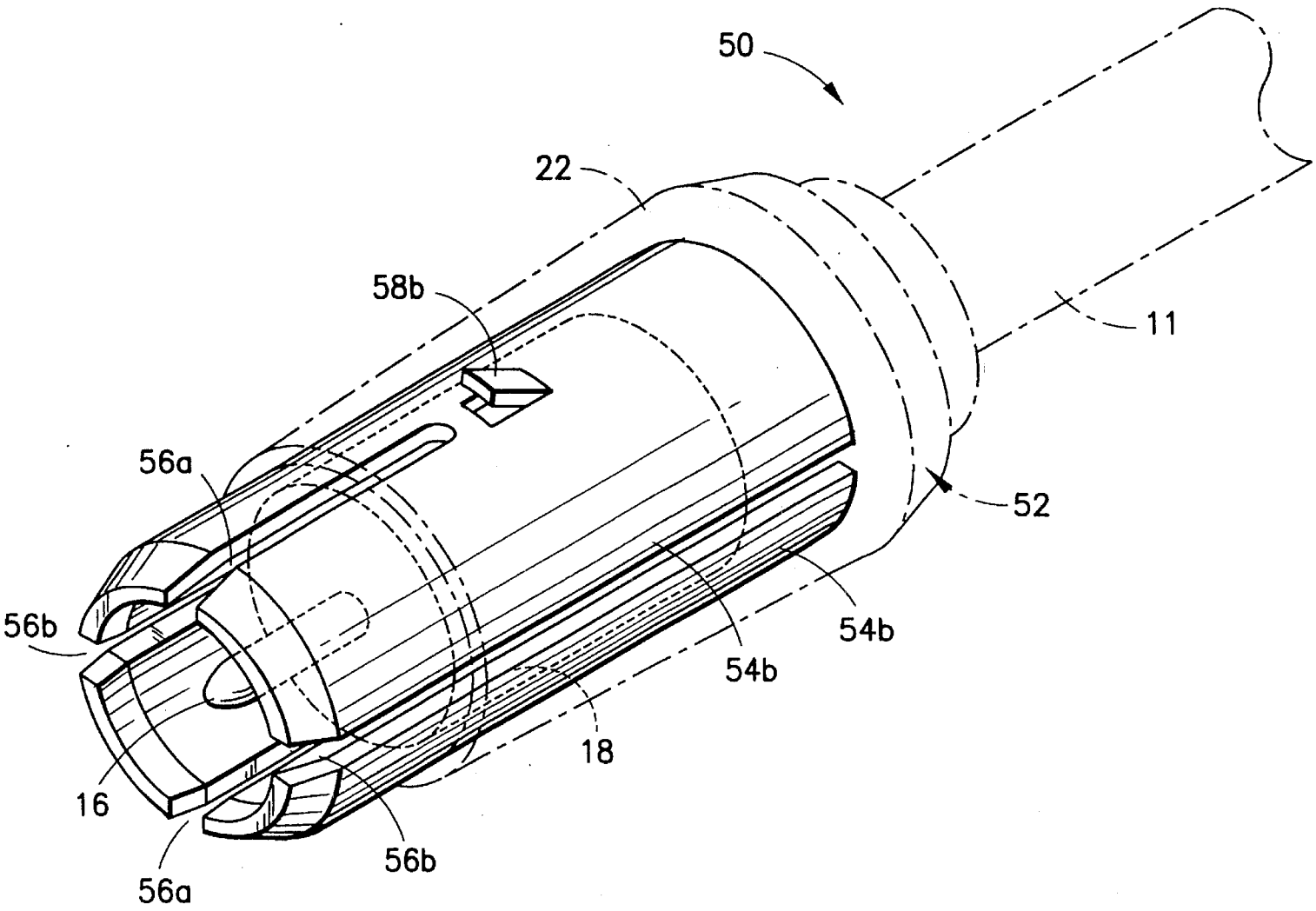
FIG. 7 shows a perspective view of a fourth embodiment of the present invention.
Figure 8:
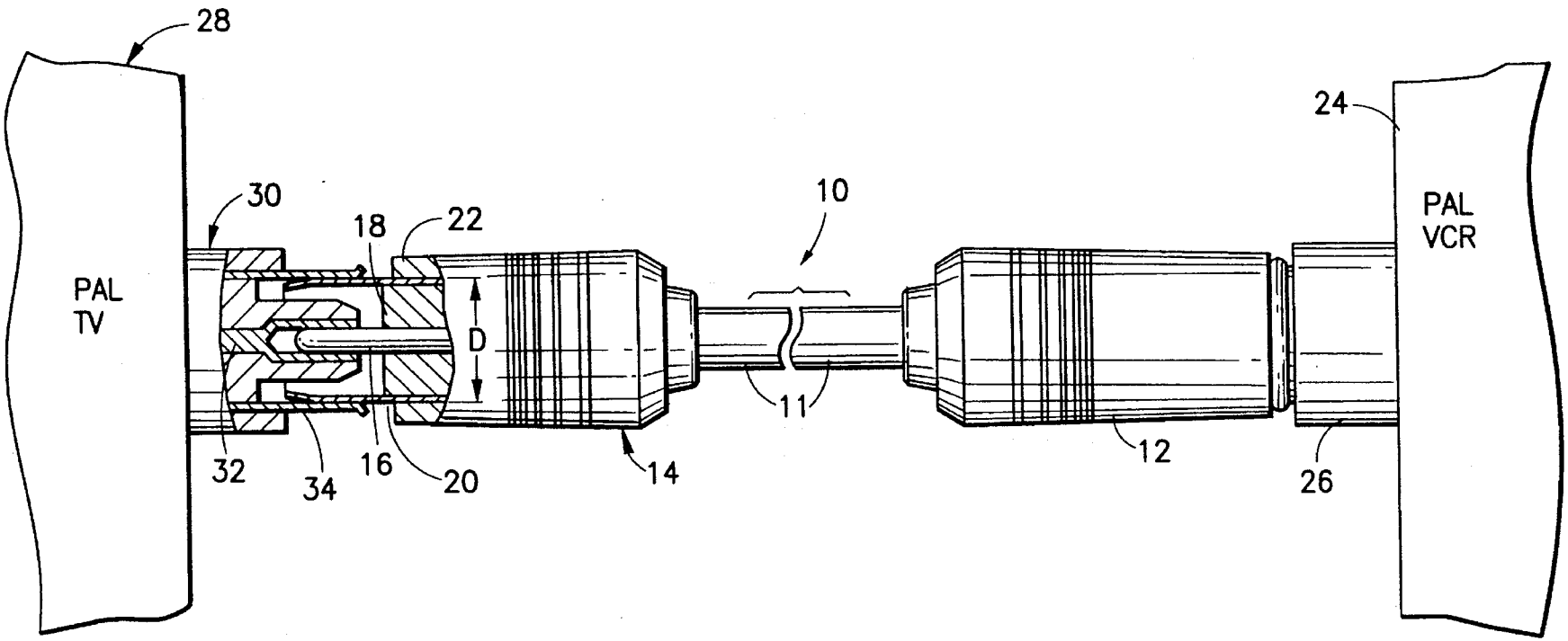
FIG. 8 PRIOR ART
FIG. 8 shows fragmentary elevation view of a connector according to the prior art, in which a cable with a PAL format connector is used to connect a PAL format VCR with a PAL format TV.
Figure 9:
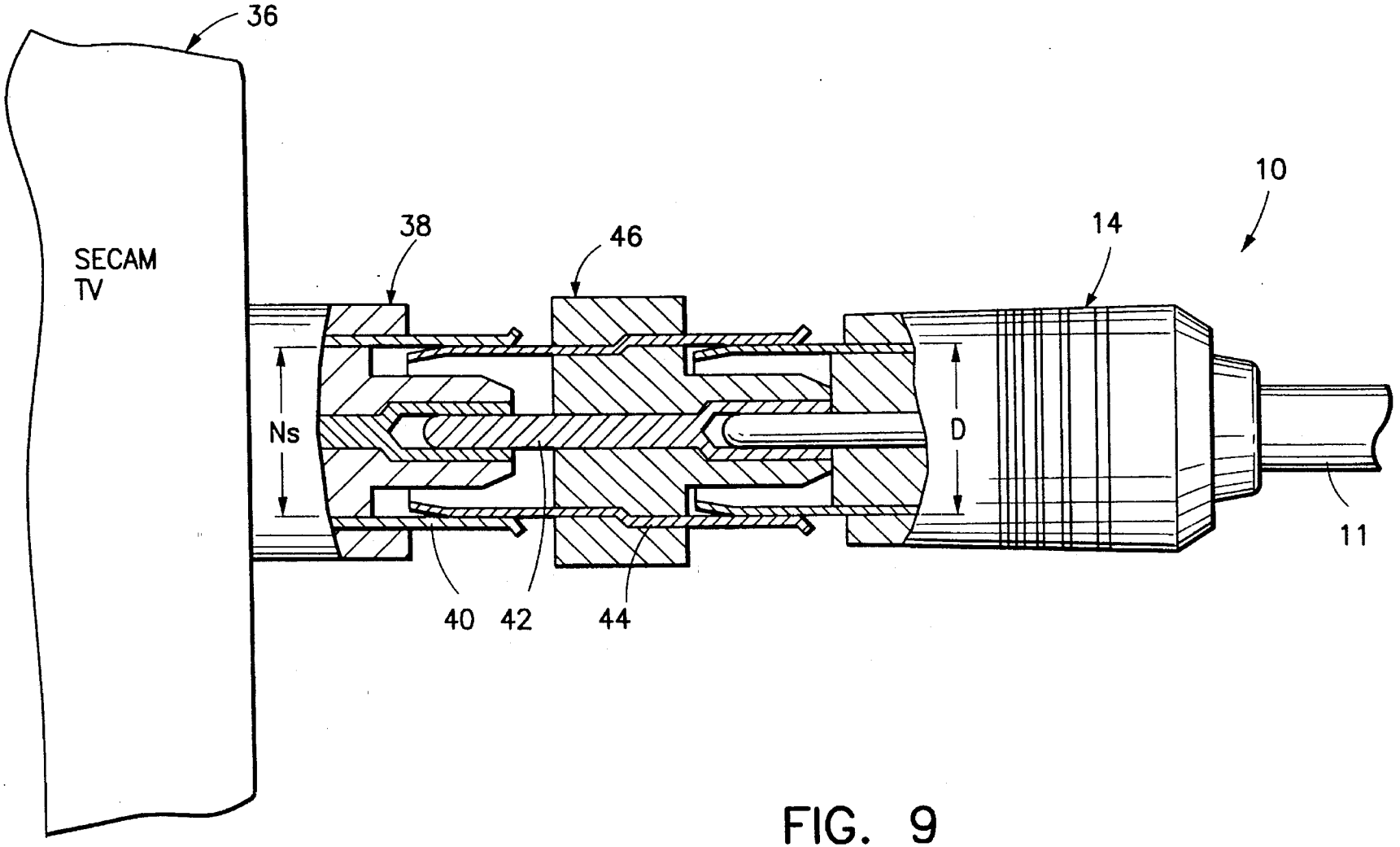
FIG. 9 PRIOR ART
FIG. 9 shows a fragmentary elevation view of a conversion connector according to the prior art, in which a cable with a PAL format connector is used with the conversion connector to connect a PAL format VCR with a SECAM format TV.

Referring to FIG. 7, an alternative embodiment includes a plurality of slits 56*b* that are open at both ends as well as a plurality of slits 56*a* that are closed at one end. If two slits 56*b* form two sleeve pieces 54*b*, slip-prevention engagement pieces 58*b* on each sleeve piece 54*b* engage cover 22. In this embodiment, two slits 56*a* and two slits 56*b* are preferable.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cable connector, comprising:

a plug for alternate connection to first and second receptacles;

said first and second receptacles having first and second tubular grounding terminals, respectively;

said first grounding terminal having a first inner diameter;

said second grounding terminal having a second inner diameter;

said second inner diameter being smaller than said first inner diameter;

said plug having a generally tubular sleeve for fitting inside a grounding terminal;

a chamfer at an end of said sleeve;

a plurality of slits longitudinally disposed in said sleeve, extending through said chamfer;

said sleeve having an unstressed outer diameter;

said unstressed outer diameter being effective for providing an elastic interference fit in said first inner diameter; and said chamfer and said plurality of slits permitting said sleeve to compress to form an interference fit inside said second inner diameter.

2. A cable connector according to claim 1, wherein at least one slit extends full length.

3. A cable connector according to claim 1, wherein said plurality of slits extend full length to separate said sleeve into a plurality of sleeve pieces.

4. A cable connector according to claim 1, wherein:

at least one slit extends full length; and at least a second slit extends less than full length.

5. A cable connector according to claim 1, wherein said plurality of slits widen toward said chamfered end of said sleeve.

6. A cable connector according to claim 1, further comprising:

a cover on said plug; and a portion of said sleeve extending beyond said cover.

7. A cable connector according to claim 6, wherein said plurality of slits stop at an edge of said cover.

8. A cable connector according to claim 6, wherein said plurality of slits extend under an edge of said cover.

9. A cable connector according to claim 1, wherein:

said first inner diameter is for a first format; and said second inner diameter is for a second format.

10. A cable connector according to claim 9, wherein:

said first inner diameter is 9,525 mm; and said second inner diameter is 9.0 mm.

* * * * *

UNITED STATES PATENT AND TRADEMARK OFFICE

CERTIFICATE OF CORRECTION

PATENT NO. : 5,556,292

DATED : September 17, 1996

INVENTOR(S) : Tatsuo KATO, Katsuhiko KISHI, and Takeshi MATSUDA

It is certified that errors appear in the above-identified patent and that said Letters Patent is hereby corrected as shown below:

Column 4, line 19, please change "9,525" to --9.525--;

Column 4, line 21, please change "9,525" to --9.525--;

Column 4, line 62, please change "dosed" to --closed--;

Column 4, line 62, please change "56*a*extend" to --56*a* extend--;

Column 6, line 37, please chnage "9,525" to --9.525--.

Signed and Sealed this

Twenty-third Day of September, 1997

*Attest:*

Bruce Lehman

BRUCE LEHMAN

*Attesting Officer*

*Commissioner of Patents and Trademarks*